US010186757B2

(12) United States Patent
Cai et al.

(10) Patent No.: US 10,186,757 B2
(45) Date of Patent: Jan. 22, 2019

(54) ANTENNA AND WIRELESS DEVICE

(71) Applicant: Huawei Technologies Co., Ltd., Shenzhen (CN)

(72) Inventors: Hua Cai, Shenzhen (CN); Keli Zou, Shenzhen (CN)

(73) Assignee: Huawei Technologies Co., Ltd, Shenzhen (CN)

( * ) Notice: Subject to any disclaimer, the term of this patent is extended or adjusted under 35 U.S.C. 154(b) by 171 days.

(21) Appl. No.: 15/237,205

(22) Filed: Aug. 15, 2016

(65) Prior Publication Data

US 2016/0352001 A1 Dec. 1, 2016

Related U.S. Application Data

(63) Continuation of application No. PCT/CN2014/077276, filed on May 12, 2014.

(51) Int. Cl.
*H01Q 1/24* (2006.01)
*H01Q 13/28* (2006.01)
(Continued)

(52) U.S. Cl.
CPC ..... *H01Q 1/243* (2013.01); *H01Q 1/38* (2013.01); *H01Q 1/48* (2013.01); *H01Q 1/50* (2013.01);
(Continued)

(58) Field of Classification Search
CPC .... H01Q 1/243; H01Q 21/0031; H01Q 13/20; H01Q 9/285; H01Q 1/48; H01Q 1/38;
(Continued)

(56) References Cited

U.S. PATENT DOCUMENTS 4,150,382 A 4/1979 King
6,127,985 A * 10/2000 Guler ..... H01Q 13/10 343/770
(Continued)

FOREIGN PATENT DOCUMENTS

CN 101395759 A 3/2009
CN 101533960 A 9/2009
(Continued)

OTHER PUBLICATIONS

Bertuch, T., "A TM Leaky-Wave Antenna Comprising a Textured Surface," 2007 International Conference on Electromagnetics in Advanced Applications, Sep. 17-21, 2007, pp. 515-518, Torino.
(Continued)

*Primary Examiner* — Jean B Jeanglaude
(74) *Attorney, Agent, or Firm* — Slater Matsil, LLP

(57) ABSTRACT

An antenna includes a main body and multiple gain compensation structures. The main body includes a top board and a bottom board, multiple radiation structures are provided on the top board and a feed structure is provided on the bottom board. The multiple gain compensation structures are for partitioning the main body to at least two radiation areas. Each gain compensation structure includes multiple gain compensation units and a shielding structure, and the shielding structure is located between the top board and the bottom board. Each gain compensation unit includes a first coupling structure located on a side that is of the shielding structure and that faces the feed structure. At least a portion of the first coupling structure is located between the top board and the bottom board.

18 Claims, 8 Drawing Sheets

(51) Int. Cl.

| | |
|---|---|
| ***H01Q 1/38*** | (2006.01) |
| ***H01Q 1/48*** | (2006.01) |
| ***H01Q 1/50*** | (2006.01) |
| ***H01Q 9/28*** | (2006.01) |
| ***H01Q 13/20*** | (2006.01) |
| ***H01Q 21/00*** | (2006.01) |

(52) U.S. Cl.
CPC ..... *H01Q 9/285* (2013.01); *H01Q 13/20* (2013.01); *H01Q 13/28* (2013.01); *H01Q 21/0031* (2013.01)

(58) Field of Classification Search
CPC H01Q 1/50; H01Q 13/28; H01Q 1/24; H01Q 21/00
USPC ..... 343/770, 702, 771
See application file for complete search history.

(56) References Cited

U.S. PATENT DOCUMENTS

| | | | | |
|---|---|---|---|---|
| 6,535,173 | B2 * | 3/2003 | Ou | H01Q 21/005 343/770 |
| 6,727,860 | B1 * | 4/2004 | Svensson | H01Q 13/10 333/125 |
| 6,861,996 | B2 * | 3/2005 | Jeong | H01Q 1/523 29/600 |
| 6,870,438 | B1 * | 3/2005 | Shino | H01L 23/66 333/247 |
| 2002/0101385 | A1 * | 8/2002 | Huor | H01Q 21/005 343/770 |
| 2004/0227664 | A1 | 11/2004 | Noujeim | |
| 2007/0176846 | A1 | 8/2007 | Vazquez et al. | |
| 2009/0079648 | A1 | 3/2009 | Matsuo et al. | |
| 2010/0110943 | A2 | 5/2010 | Gummalla et al. | |
| 2010/0308651 | A1 | 12/2010 | Rofougaran et al. | |
| 2010/0309078 | A1 | 12/2010 | Rofougaran et al. | |

FOREIGN PATENT DOCUMENTS

| | | | |
|---|---|---|---|
| CN | 101980449 | A | 2/2011 |
| CN | 102394378 | A | 3/2012 |
| CN | 103441340 | A | 12/2013 |

OTHER PUBLICATIONS

Casares-Miranda, F. et al., "High-Gain Active Composite Right/Left-Handed Leaky-Wave Antenna," IEEE Transactions on Antennas and propagation, Aug. 2006, pp. 2292-2300, vol. 54, No. 8.

Mahmoud, S. et al., "Study of Surface Waves on Planar High-Gain Leaky-Wave Antennas," IEEE Antennas and Wireless Propagation Letters, Dec. 10, 2010, pp. 1186-1189, vol. 9.

* cited by examiner

ANTENNA AND WIRELESS DEVICE

CROSS-REFERENCE TO RELATED APPLICATIONS

This application is a continuation of International Application No. PCT/CN2014/077276 filed on May 12, 2014, which application is hereby incorporated herein by reference.

TECHNICAL FIELD

The present application relates to the field of communications technologies, and in particular, to an antenna and a wireless device.

BACKGROUND

In the field of communications technologies, with the development of emerging applications, wireless access networks are developing toward high-capacity, millimeter-wave, and multiple-band applications. Therefore, wireless devices impose a higher requirement on antennas. To adapt to this requirement, an antenna needs to be in a low-profile form to meet a requirement of millimeter-wave band wireless device integration, and also needs to have a high gain feature to adapt to a scenario of high attenuation during millimeter-wave band signal propagation.

Because a feeding unit and a radiation unit of a leaky wave antenna (LWA) are simple in structure, and the leaky wave antenna is suitable for a planar structure and has a wideband feature, the leaky wave antenna has become a main technical solution used in design of a low-cost, low-profile, and wideband antenna.

A radiation principle of the leaky wave antenna is: A signal wave formed by means of excitation inside the leaky wave antenna by a feeding unit is radiated in a form of a leaky wave and along an aperture formed by the leaky wave antenna, to implement signal transmission.

However, when a leaky wave antenna in the prior art transmits a millimeter-wave band signal, because the signal is transmitted along an aperture of the leaky wave antenna at the same time when a leaky wave is radiated, a signal amplitude of the leaky wave antenna is attenuated exponentially in a surrounding direction from the feeding unit, on an aperture plane, of the leaky wave antenna, causing relatively low aperture efficiency of the antenna and a relatively low gain of the antenna.

SUMMARY

The present application provides an antenna and a wireless device. The antenna can increase antenna aperture efficiency and improve an antenna gain.

According to a first aspect, an antenna is provided. The antenna includes a main body, where the main body includes a top board and a bottom board that are disposed in parallel, where multiple radiation structures used for signal leakage are provided on the top board, and a feed structure used for signal excitation is provided on the bottom board, to generate, between the top board and the bottom board, a TE wave and a TM wave that are transmittable. The antenna also includes multiple lines of gain compensation structures, for partitioning the main body to at least two radiation areas, where each radiation area includes a portion of the radiation structures in the multiple radiation structures and each line of gain compensation structure includes multiple gain compensation units and a shielding structure extending in an arrangement direction of the multiple gain compensation units, where the shielding structure is located between the top board and the bottom board to isolate the two radiation areas. Each gain compensation unit includes: a first coupling structure, where the first coupling structure is located on a side that is of the shielding structure and that faces the feed structure, and at least a portion of the first coupling structure is located between the top board and the bottom board; a second coupling structure, where the second coupling structure is located on a side that is of the shielding structure and that faces away from the feed structure, and at least a portion of the second coupling structure is located between the top board and the bottom board; and a first single stage traveling wave amplifying unit, where when the first single stage traveling wave amplifying unit is working, an input end of the first single stage traveling wave amplifying unit is connected to the first coupling structure and an output end of the first single stage traveling wave amplifying unit is connected to the second coupling structure.

With reference to the first aspect, in a first possible implementation manner, the top board is a metal board with a left-handed material or right-handed material structure, and the bottom board is a good-conductor metal board or is a metal board with a left-handed material or right-handed material structure.

With reference to the first aspect, in a second possible implementation manner, air is filled between the top board and the bottom board, and a support structure is provided between the top board and the bottom board, to provide support between the top board and the bottom board; or a medium layer is provided between the top board and the bottom board.

With reference to the first aspect, in a third possible implementation manner, of the multiple lines of gain compensation structures: an arrangement direction of gain compensation units in at least one line of gain compensation structure is perpendicular to a propagation direction of the TE wave generated by the feed structure by means of excitation, and an arrangement direction of gain compensation units in at least one line of gain compensation structure is perpendicular to a propagation direction of the TM wave generated by the feed structure by means of excitation; or arrangement directions of gain compensation units in the lines of gain compensation structures are parallel to each other and perpendicular to a propagation direction of the TE wave generated by the feed structure by means of excitation; or arrangement directions of gain compensation units in the lines of gain compensation structures are parallel to each other and perpendicular to a propagation direction of the TM wave generated by the feed structure by means of excitation.

With reference to the third possible implementation manner, in a fourth possible implementation manner, the multiple lines of gain compensation structures form at least one closed-loop gain compensation structure, where: each gain compensation structure includes two lines of gain compensation structures with an arrangement direction of gain compensation units perpendicular to the propagation direction of the TE wave and two lines of gain compensation structures with an arrangement direction of gain compensation units perpendicular to the propagation direction of the TM wave; and projection of the feed structure on a side that is of the bottom board and that faces away from the top board is within an area bounded by projection of the closed-loop gain compensation structure on the side that is of the bottom board and that faces away from the top board.

With reference to the third possible implementation manner, in a fifth possible implementation manner, in each gain compensation unit, a passive reciprocal structure is provided between the first coupling structure and the second coupling structure.

With reference to the fifth possible implementation manner, in a sixth possible implementation manner, in each gain compensation unit: the first coupling structure is a coupling probe, where a first end of the coupling probe is connected to an input end of a corresponding first single stage traveling wave amplifying unit by using a conductor, and a second end of the coupling probe extends to between the top board and the bottom board. The second coupling structure is a coupling probe, where a first end of the coupling probe is connected to an output end of the corresponding first single stage traveling wave amplifying unit by using a conductor, and a second end of the coupling probe extends to between the top board and the bottom board; when an arrangement direction of gain compensation units in a line of gain compensation structure is perpendicular to the propagation direction of the TE wave, second ends of all coupling probes form a symmetrical dipole, and a conductor between a first end of the coupling probe and the first single stage traveling wave amplifying unit is in an 180° balun structure; and when an arrangement direction of gain compensation units in a line of gain compensation structure is perpendicular to the propagation direction of the TM wave, second ends of all coupling probes form a loop structure.

With reference to the sixth possible implementation manner, in a seventh possible implementation manner, when an arrangement direction of gain compensation units in a line of gain compensation structure is perpendicular to the propagation direction of the TE wave, a distance from each coupling probe to the shielding structure is one fourth of a wavelength of the TE wave; and when an arrangement direction of gain compensation units in a line of gain compensation structure is perpendicular to the propagation direction of the TM wave, a distance from each coupling probe to the shielding structure is one half of a wavelength of the TM wave.

With reference to the seventh possible implementation manner, in an eighth possible implementation manner, when an arrangement direction of gain compensation units in a line of gain compensation structure is perpendicular to the propagation direction of the TE wave, a distance between two adjacent coupling probes is less than or equal to one half of the wavelength of the TE wave; and when an arrangement direction of gain compensation units in a line of gain compensation structure is perpendicular to the propagation direction of the TM wave, a distance between two adjacent coupling probes is less than or equal to one half of the wavelength of the TM wave.

With reference to the first aspect, in a ninth possible implementation manner, the multiple radiation structures used for leakage and provided on the top board include: multiple rectangular opening grooves provided on the top board, where rectangular opening grooves in each radiation area are arranged in an array, and of any two adjacent side walls of each rectangular opening groove, one side wall is perpendicular to a propagation direction of the TM wave generated by the feed structure by means of excitation and the other side wall is perpendicular to a propagation direction of the TE wave generated by the feed structure by means of excitation; or multiple parallel long grooves provided on the top board, where a longitudinal direction of the long groove is perpendicular to a propagation direction of the TM wave generated by the feed structure by means of excitation, or a longitudinal direction of the long groove is perpendicular to a propagation direction of the TE wave generated by the feed structure by means of excitation.

With reference to the first aspect, the first possible implementation manner, the second possible implementation manner, the third possible implementation manner, the fourth possible implementation manner, the fifth possible implementation manner, the sixth possible implementation manner, the seventh possible implementation manner, the eighth possible implementation manner, or the ninth possible implementation manner, in a tenth possible implementation manner, in each gain compensation unit, first single stage traveling wave amplifying units are located on a side that is of the top board and that faces away from the bottom board, a medium layer is provided between the top board and each single stage traveling wave amplifying unit, and a ground end of each single stage traveling wave amplifying unit is connected to the top board by using a ground wire.

With reference to the first aspect, the first possible implementation manner, the second possible implementation manner, the third possible implementation manner, the fourth possible implementation manner, the fifth possible implementation manner, the sixth possible implementation manner, the seventh possible implementation manner, the eighth possible implementation manner, or the ninth possible implementation manner, in an eleventh possible implementation manner, each gain compensation unit further includes a second single stage traveling wave amplifying unit, a switch structure is provided between an input end of the second single stage traveling wave amplifying unit and the second coupling structure, and between an output end of the first single stage traveling wave amplifying unit and the second coupling structure, and a switch structure is provided between an output end of the second single stage traveling wave amplifying unit and the first coupling structure, and between an input end of the first single stage traveling wave amplifying unit and the first coupling structure, where when both the switch structures are in a first state, the input end of the first single stage traveling wave amplifying unit is connected to the first coupling structure and the output end is connected to the second coupling structure; and when both the switch structures are in a second state, the output end of the second single stage traveling wave amplifying unit is connected to the first coupling structure and the input end is connected to the second coupling structure.

According to a second aspect, a wireless device is provided, including the antenna provided in the first aspect and all possible implementation manners of the first aspect.

For the antenna according to the first aspect and the wireless device according to the second aspect, a feed structure provided on a bottom board of the antenna can excite and generate a TE wave and a TM wave between the top board and bottom board of the antenna. Then the TE wave and the TM wave are radiated in a form of a leaky wave by using radiation structures provided on the top board. In multiple lines of gain compensation structures of the antenna, when a first single stage traveling wave amplifying unit of each gain compensation unit is working, an input end of the first single stage traveling wave amplifying unit is connected to a first coupling structure on a side that is of a shielding structure and that faces the feed structure and an output end of the first single stage traveling wave amplifying unit is connected to a second coupling structure on a side that is of the shielding structure and that faces away from the feed structure. Therefore, when the first single stage traveling wave amplifying unit is working, in radiation areas on both sides of each line of gain compensation structure, the first coupling structure can guide a signal in an antenna structure corresponding to a radiation area nearer to the feed structure into the first single stage traveling wave amplifying unit, so as to make gain compensation for a signal amplitude that is already attenuated by using the first single stage traveling wave amplifying unit, and then input the signal to an antenna structure corresponding to a radiation area farther from the feed structure by using the second coupling structure. After a signal that is already attenuated passes through a first single stage traveling wave amplifying unit, gain compensation can be made for an attenuated signal amplitude by using the first single stage traveling wave amplifying unit, thereby suppressing a taper effect in which an amplitude of a signal is gradually attenuated because of gradual leaky wave radiation of an antenna. In this way, aperture efficiency of the antenna is increased and an antenna gain is improved.

Therefore, the antenna provided in the present application can increase antenna aperture efficiency and improve an antenna gain.

BRIEF DESCRIPTION OF THE DRAWINGS

To describe the technical solutions in the embodiments of the present application more clearly, the following briefly describes the accompanying drawings required for describing the embodiments. Apparently, the accompanying drawings in the following description show some embodiments of the present application, and persons of ordinary skill in the art may still derive other drawings from these accompanying drawings without creative efforts.

DETAILED DESCRIPTION OF ILLUSTRATIVE EMBODIMENTS

The following clearly describes the technical solutions in the embodiments of the present application with reference to the accompanying drawings in the embodiments of the present application. Apparently, the described embodiments are a part rather than all of the embodiments of the present application. All other embodiments obtained by persons of ordinary skill in the art based on the embodiments of the present application without creative efforts shall fall within the protection scope of the present application.

The embodiments of the present application provide an antenna and a wireless device equipped with the antenna. The antenna can make gain compensation for a signal between a top board and a bottom board of the antenna, thereby suppressing a taper effect in which an amplitude of a signal is gradually attenuated because of gradual leaky wave radiation of an antenna, increasing antenna aperture efficiency, and improving an antenna gain. The following describes the foregoing antenna and wireless device with reference to the accompanying drawings.

Figure 1:
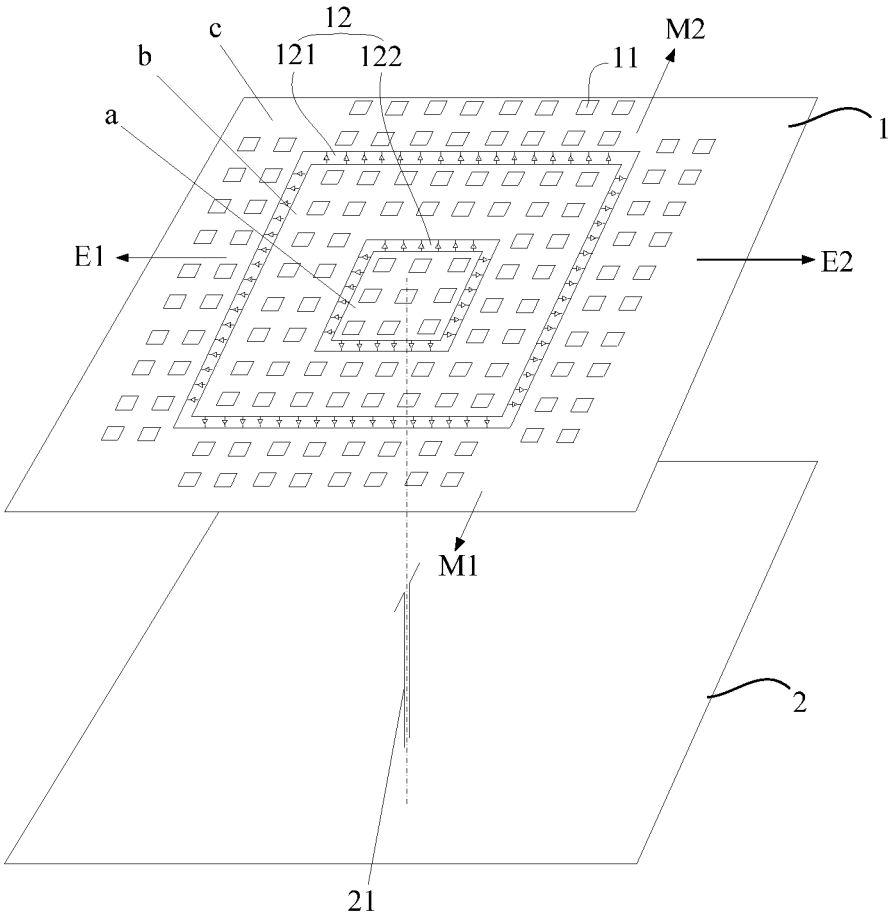
FIG. 1 is a schematic structural diagram of an antenna according to an embodiment of the present application.
Figure 2:
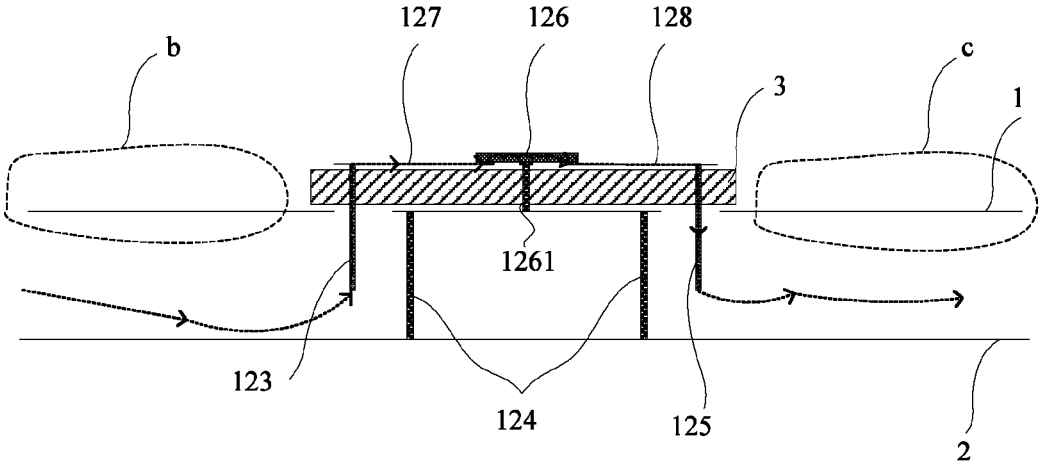
FIG. 2 is a schematic structural diagram of a gain compensation unit in an antenna according to an embodiment of the present application.
Figure 3:
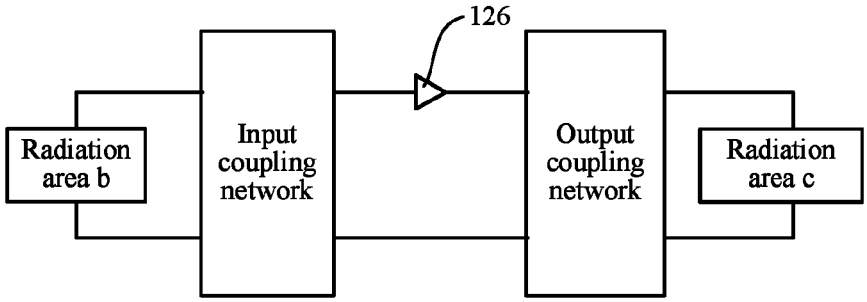
FIG. 3 is a schematic principle diagram of a gain compensation unit in an antenna according to an embodiment of the present application.

Refer to FIG. 1, FIG. 2, and FIG. 3. FIG. 1 is a schematic structural diagram of an antenna according to an embodiment of the present application. FIG. 2 is a schematic structural diagram of a gain compensation unit in an antenna according to an embodiment of the present application. FIG. 3 is a schematic principle diagram of a gain compensation unit in an antenna according to an embodiment of the present application.

As shown in FIG. 1, the antenna according to an embodiment of the present application includes: a main body, where the main body includes a top board 1 and a bottom board 2 that are disposed in parallel, where multiple radiation structures ii used for signal leakage are provided on the top board 1, and a feed structure 21 used for signal excitation is provided on the bottom board 2, to generate, between the top board 1 and the bottom board 2, a TE wave and a TM wave that are transmittable. The antenna also includes multiple lines of gain compensation structures 12, where the multiple lines of gain compensation structures partition the main body of the antenna to multiple radiation areas, and each radiation area includes a portion of the radiation structures, for example, in the antenna shown in FIG. 1, a radiation area a bounded by four lines of gain compensation structures 122, a radiation area b between the four lines of gain compensation structures 122 and four lines of gain compensation structures 121, and a radiation area c outside the four lines of gain compensation structures 121.

The antenna structure and the gain compensation structures 121 between the radiation area b and the radiation area c in FIG. 1 are used as an example. Specifically, each line of gain compensation structure 121 includes multiple gain compensation units and a shielding structure 124 extending in an arrangement direction of the multiple gain compensation units, and the shielding structure 124 is located between the top board 1 and the bottom board 2 to isolate the radiation area b and the radiation area c, thereby blocking a signal path, of the radiation area b and the radiation area c, between the top board 1 and the bottom board 2. Refer to FIG. 2 with reference to FIG. 1. As shown in FIG. 2, each gain compensation unit includes: a first coupling structure 123, where the first coupling structure 123 is located on a side that is of the shielding structure 124 and that faces the feed structure 21, and at least a portion of the first coupling structure 123 is located between the top board 1 and the bottom board 2; a second coupling structure 125, where the second coupling structure 125 is located on a side that is of the shielding structure 124 and that faces away from the feed structure 21, and at least a portion of the second coupling structure 125 is located between the top board 1 and the bottom board 2; and a first single stage traveling wave amplifying unit 126, where when the first single stage traveling wave amplifying unit 126 is working, an input end of the first single stage traveling wave amplifying unit 126 is connected to the first coupling structure 123 and an output end of the first single stage traveling wave amplifying unit 126 is connected to the second coupling structure 125, and preferably, the first single stage traveling wave amplifying unit 126 is located on an outer side of the main board.

In the antenna, the feed structure 21 provided on the bottom board 2 can excite and generate a TE wave and a TM wave between the top board and bottom board of the antenna. Then the TE wave and the TM wave are radiated in a form of a leaky wave by using the radiation structures 11 provided on the top board 1. Still a gain compensation unit in the structure shown in FIG. 2 is used as an example. With reference to FIG. 2 and FIG. 3, in the multiple lines of gain compensation structures 12 of the antenna, when a first single stage traveling wave amplifying unit 126 of each gain compensation unit is working, an input end of the first single stage traveling wave amplifying unit 126 is connected to a first coupling structure 123 on a side that is of a shielding structure 124 and that faces the feed structure 21 and an output end of the first single stage traveling wave amplifying unit 126 is connected to a second coupling structure 125 on a side that is of the shielding structure 124 and that faces away from feed structure 21. Therefore, when the first single stage traveling wave amplifying unit 126 is working, in the radiation area b and the radiation area c, the first coupling structure 123 can guide a signal in an antenna structure corresponding to a radiation area nearer to the feed structure 21 into the first single stage traveling wave amplifying unit 126, so as to make gain compensation for a signal amplitude that is already attenuated by using the first single stage traveling wave amplifying unit 126, and then input the signal to an antenna structure corresponding to a radiation area farther from the feed structure 21 by using the second coupling structure 125. After a signal that is already attenuated passes through a first single stage traveling wave amplifying unit 126, gain compensation can be made for an attenuated signal amplitude by using the first single stage traveling wave amplifying unit 126, thereby suppressing a taper effect in which an amplitude of a signal is gradually attenuated because of gradual leaky wave radiation of an antenna. In this way, aperture efficiency of the antenna is increased and an antenna gain is improved.

Therefore, the antenna provided in the present application can increase antenna aperture efficiency and improve an antenna gain.

In an embodiment, the top board 1 of the antenna is a metal board with a left-handed material or right-handed material structure, and the bottom board 2 is a good-conductor metal board or is a metal board with a left-handed material or right-handed material structure. The top board 1 and the bottom board 2 are prepared using a metal left-handed material or a metal right-handed material and can flexibly control a radiation wave form to implement control over a particular beam and broadside-to-end-fire scanning beams.

In an embodiment, air is filled between the top board 1 and the bottom board 2 of an antenna, and a support structure is provided between the top board 1 and the bottom board 2, to provide support between the top board 1 and the bottom board 2; or a medium layer is provided between the top board 1 and the bottom board 2 so that a low-cost PCB technique can be used to prepare the antenna during actual production to reduce a device cost of the antenna.

Figure 4A:
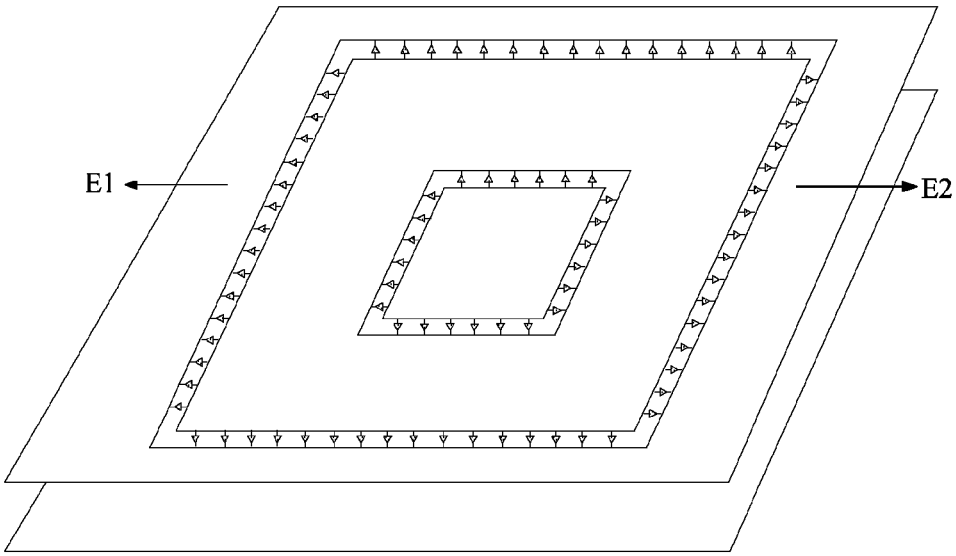
FIG. 4*a* to FIG. 4*c* are structural diagrams of distribution of gain compensation units in an antenna according to the present application.
Figure 4B:
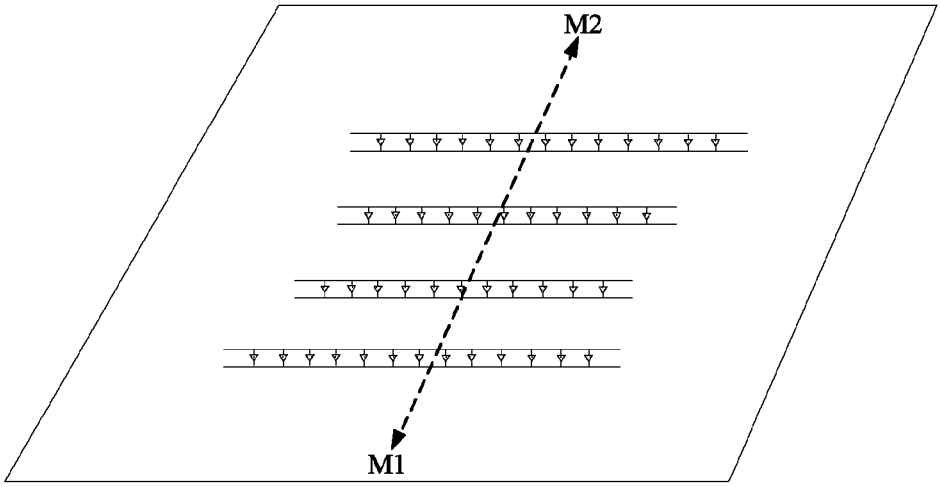
Figure 4C:
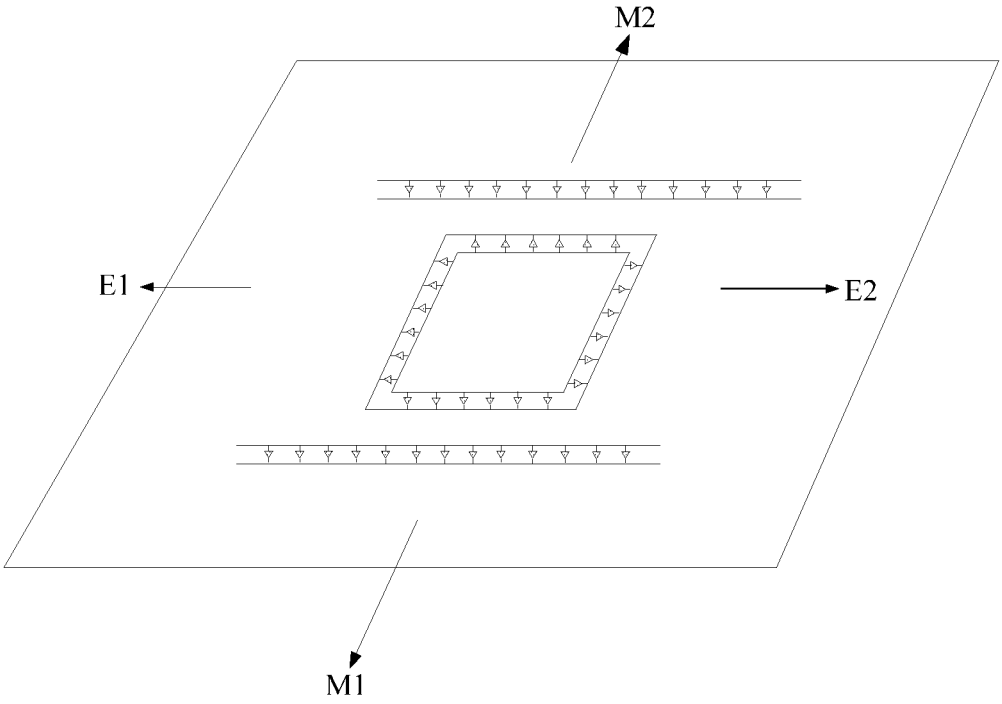

In an embodiment, referring to FIG. 4*a* to FIG. 4*c* with reference to FIG. 1, in the multiple lines of gain compensation units 12: as shown in FIG. 4*a* and FIG. 4*c*, an arrangement direction of gain compensation units in at least one line of gain compensation structure 12 is perpendicular to a propagation direction of a TE wave E1 and a TE wave E2 generated by the feed structure 21 by means of excitation, and an arrangement direction of gain compensation units in at least one line of gain compensation structure 12 is perpendicular to a propagation direction of a TM wave M1 and a TM wave M2 generated by the feed structure 21 by means of excitation; or an arrangement direction of gain compensation units in each line of gain compensation structure 12 is perpendicular to a propagation direction of a TE wave E1 and a TE wave E2 generated by the feed structure 21 by means of excitation; or as shown in FIG. 4*b*, an arrangement direction of gain compensation units in each line of gain compensation structure 12 is perpendicular to a propagation direction of a TM wave M1 and a TM wave M2 generated by the feed structure 21 by means of excitation.

As shown in FIG. 1 and FIG. 4*a*, in a preferred implementation manner, when an arrangement direction of gain compensation units of at least one line of gain compensation structure 12 is perpendicular to the propagation direction of the TE wave E1 and the TE wave E2 generated by the feed structure 21 by means of excitation, and an arrangement direction of gain compensation units of at least one line of gain compensation structure 12 is perpendicular to the propagation direction of the TM wave M1 and the TM wave M2 generated by the feed structure 21 by means of excitation, the multiple lines of gain compensation units 12 form at least one closed-loop gain compensation structure, such as a closed-loop gain compensation structure formed by the four lines of gain compensation units 121 and a closed-loop gain compensation structure formed by the four lines of gain compensation units 122, where: each closed-loop gain compensation structure includes two lines of gain compensation structures 12 with an arrangement direction of gain compensation units perpendicular to the propagation direction of the TE wave and two lines of gain compensation structures 12 with an arrangement direction of gain compensation units perpendicular to the propagation direction of the TM wave; and projection of the feed structure 21 on a side that is of the bottom board 2 and that faces away from the top board 1 is within an area bounded by projection of the closed-loop compensation gain structure on the side that is of the bottom board 2 and that faces away from the top board 1. As shown in FIG. 1, projection of the feed structure 21 on the side that is of the bottom board 2 and that faces away from the top board 1 is within projection of the radiation area a on the side that is of the bottom board 1 and that faces away from the top board 2.

In another preferred implementation manner, as shown in FIG. 2, in each line of gain compensation units 12, a passive reciprocal structure is provided between the first coupling structure 123 and the coupling structure 125.

Figure 5:
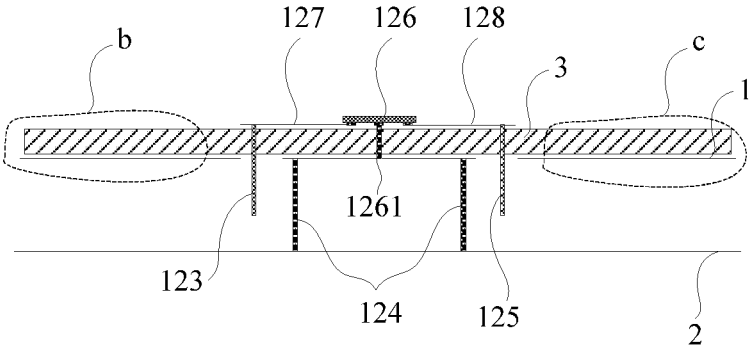
FIG. 5 is a schematic structural diagram of a gain compensation unit in an antenna according to another embodiment of the present application.
Figure 6:
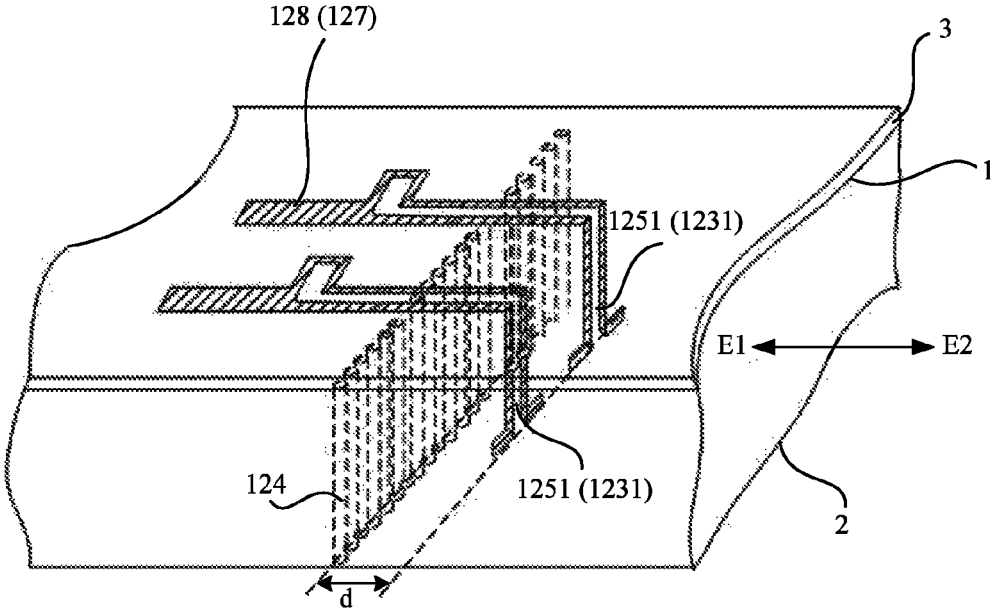
FIG. 6 is a schematic structural diagram of a coupling structure in an antenna according to an embodiment of the present application.
Figure 7:
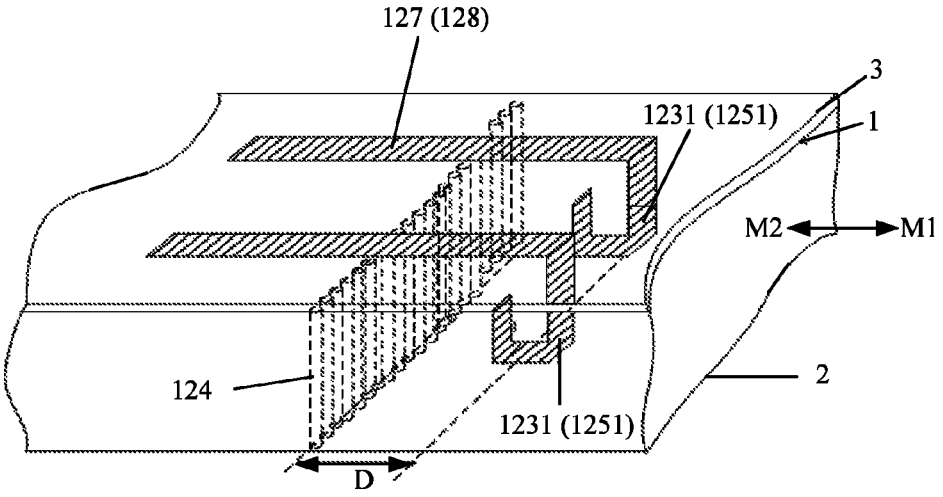
FIG. 7 is a schematic structural diagram of a coupling structure in an antenna according to another embodiment of the present application.

Further, referring to FIG. 6 and FIG. 7 with reference to FIG. 5, in each gain compensation unit, the first coupling structure 123 is a coupling probe, for example, a coupling probe 1231 in FIG. 7, where a first end of the coupling probe 1231 is connected to an input end of a corresponding first single stage traveling wave amplifying unit 126 by using a conductor 127, and a second end of the coupling probe 1231 extends to between the top board 1 and the bottom board 2; and the second coupling structure 125 is a coupling probe, for example, a coupling probe 1251 in FIG. 6, where a first end of the coupling probe 1251 is connected to an output end of the corresponding first single stage traveling wave amplifying unit 126 by using a conductor 128, and a second end of the coupling probe 1251 extends to between the top board 1 and the bottom board 2.

As shown in FIG. 6, when an arrangement direction of gain compensation units in a line of gain compensation structure 12 is perpendicular to a propagation direction of the TE wave generated by the feed structure 21 by means of excitation, as shown in FIG. 6, second ends of all coupling probe 1231 and all coupling probe 1251 corresponding to the line of gain compensation units form a symmetrical dipole, a conductor 127 between a first end of the coupling probe 1231 and the first single stage traveling wave amplifying unit 126 is in a 180° balun structure, and a conductor 128 between a first end of the coupling probe 1251 and the first single stage traveling wave amplifying unit 126 is in a 180° balun structure. Because an electric field direction is parallel to an antenna board, an induced current on the symmetrical dipole, in a reverse direction, needs to be combined by using a 180° balun structure.

As shown in FIG. 7, when an arrangement direction of gain compensation units in a line of gain compensation structure 12 is perpendicular to the propagation direction of the TM wave generated by the feed structure 21 by means of excitation, as shown in FIG. 7, second ends of all coupling probes 1231 and all coupling probes 1251 corresponding to the line of gain compensation units form a loop structure.

Further, as shown in FIG. 6, when an arrangement direction of gain compensation units in a line of gain compensation structure 12 is perpendicular to the propagation direction of the TE wave E1 and the TE wave E2 generated by the feed structure 21 by means of excitation, a distance d from each coupling probe 1231 and each coupling probe 1251 to the shielding structure 124 is one fourth of a wavelength of the TE wave, because an electric intensity of the TE wave is the greatest in this position.

Figure 8:
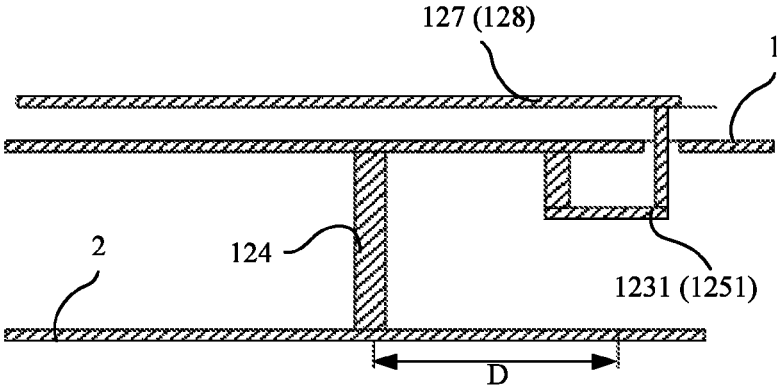
FIG. 8 is a side view of the coupling structure illustrated in FIG. 7.

As shown in FIG. 7 and FIG. 8, when an arrangement direction of gain compensation units in a line of gain compensation structure 12 is perpendicular to the propagation direction of the TM wave generated by the feed structure 21 by means of excitation, a distance D from each coupling probe 1231 and each coupling probe 1251 to the shielding structure 124 is one half of a wavelength of the TM wave, because an electric intensity of the TM wave is the greatest in this position.

Further, when an arrangement direction of gain compensation units in a line of gain compensation structure 12 is perpendicular to the propagation direction of the TE wave generated by the feed structure 21 by means of excitation, a distance between two adjacent coupling probes is less than or equal to one half of the wavelength of the TE wave to prevent higher order mode propagation.

When an arrangement direction of gain compensation units in a line of gain compensation structure 12 is perpendicular to the propagation direction of the TM wave generated by the feed structure 21 by means of excitation, a distance between two adjacent coupling probes is less than or equal to one half of the wavelength of the TM wave to prevent higher order mode propagation.

Figure 9A:
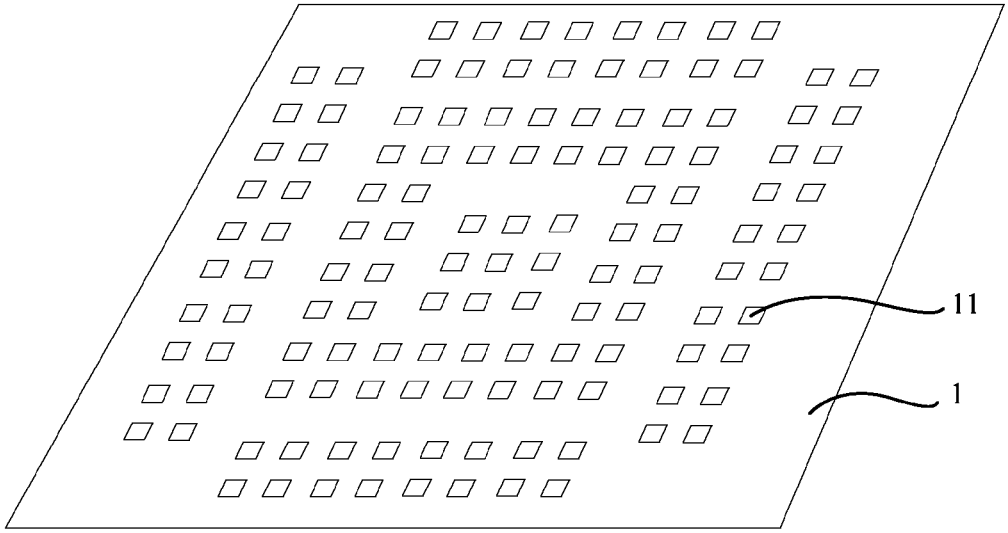
FIG. 9*a* to FIG. 9*c* are schematic structural diagrams of radiation structures provided on a top board in an antenna according to an embodiment of the present application.
Figure 9B:
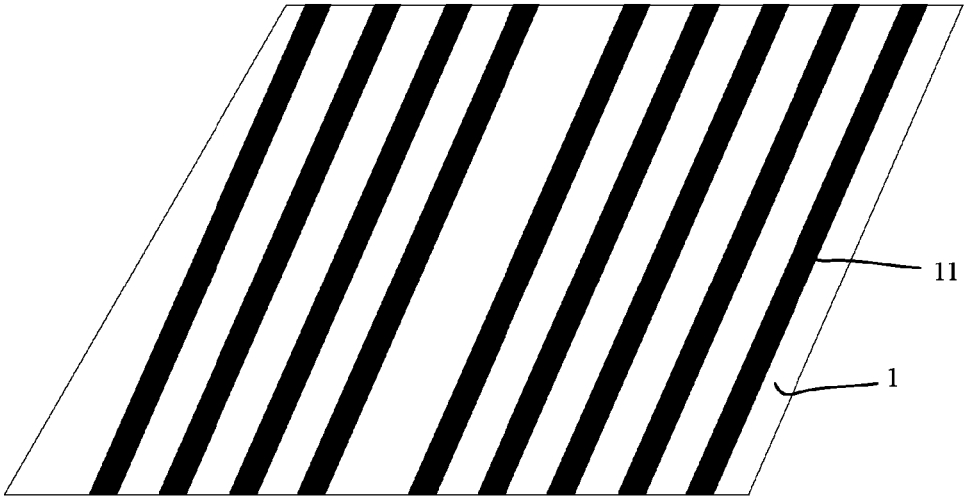
Figure 9C:
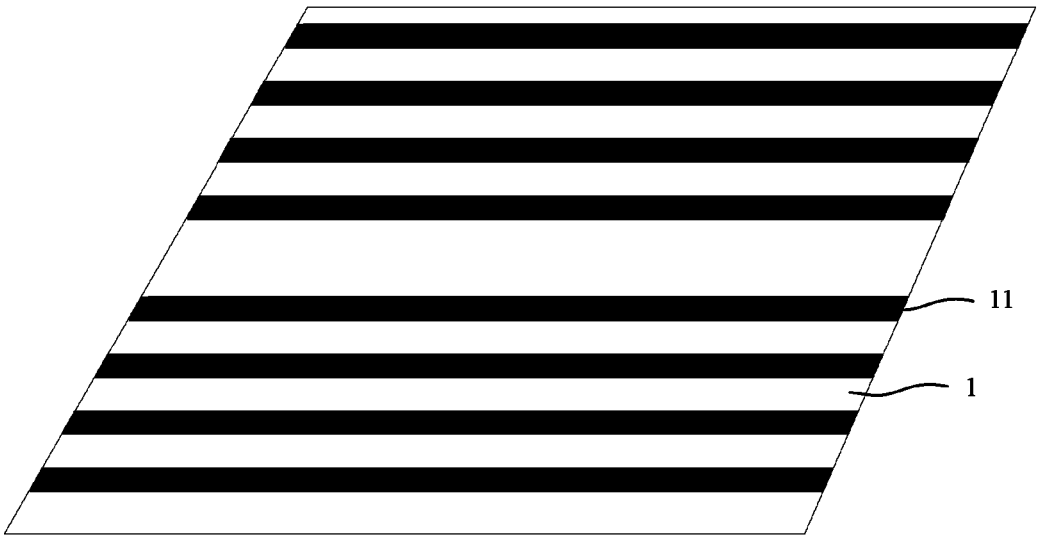

In an implementation manner, referring to FIG. 9*a* to FIG. 9*c*, the multiple radiation structures ii used for leakage and provided on the top board 1 includes: as shown in FIG. 9*a*, the radiation structures 11 may be multiple rectangular opening grooves provided on the top board 1, where rectangular opening grooves in each radiation area are arranged in an array, and of any two adjacent side walls of each rectangular opening groove, one side wall is perpendicular to a propagation direction of the TM wave generated by the feed structure 21 by means of excitation and the other side wall is perpendicular to a propagation direction of the TE wave generated by the feed structure 21 by means of excitation; or as shown in FIG. 9*b* and FIG. 9*c*, the radiation structures 11 may also be multiple parallel long grooves provided on the top board 1, where a longitudinal direction of the long groove is perpendicular to a propagation direction of the TE wave generated by the feed structure 21 by means of excitation, or a longitudinal direction of the long groove is perpendicular to a propagation direction of the TM wave generated by the feed structure 21 by means of excitation.

In an embodiment, referring to FIG. 2 and FIG. 5, in the multiple lines of gain compensation structures 12, first single stage traveling wave amplifying units 126 of each line of gain compensation structure 12 are located on a side that is of the top board 1 and that faces away from the bottom board 2, a medium layer 3 is provided between the top board 1 and each single stage traveling wave amplifying unit 126, and a ground end of each single stage traveling wave amplifying unit 126 is connected to the top board 1 by using a ground wire 1261 to implement grounding of the first single stage traveling wave amplifying unit 126. The medium layer 3 may be provided only between the first single stage traveling wave amplifying unit 126 and the top board 1, as shown in FIG. 2; or the medium layer 3 may cover the side that is of the top board 1 and that faces away from the bottom board 2, as shown in FIG. 5. Surely, the first single stage traveling wave amplifying unit 126 may also be formed on a side that is of the bottom board 2 and that faces away from the top board 1. A specific structure is not described herein.

Figure 10:
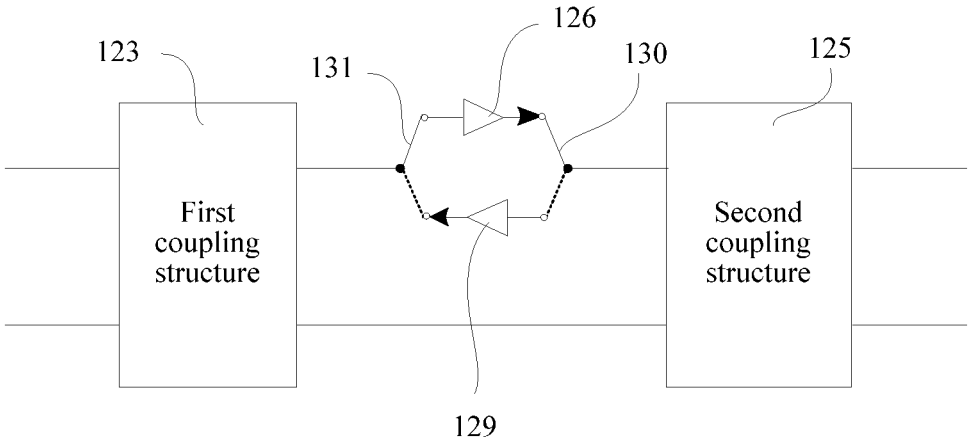
FIG. 10 is a schematic diagram of a gain compensation unit with time-division bidirectional gain compensation in an antenna according to an embodiment of the present application.

Referring to FIG. 10, in an embodiment, each gain compensation unit further includes a second single stage traveling wave amplifying unit 129, a switch structure 130 is provided between an input end of the second single stage traveling wave amplifying unit 129 and the second coupling structure 125, and between an output end of the first single stage traveling wave amplifying unit 126 and the second coupling structure 125, and a switch structure 131 is provided between an output end of the second single stage traveling wave amplifying unit 129 and the first coupling structure 123, and between an input end of the first single stage traveling wave amplifying unit and the first coupling structure 123, where: when both the switch structure 130 and the switch structure 131 are in a first state, the input end of the first single stage traveling wave amplifying unit 126 is connected to the first coupling structure 123 and the output end of the first single stage traveling wave amplifying unit 126 is connected to the second coupling structure 125; and when both the switch structure 130 and the switch structure 131 are in a second state, the output end of the second single stage traveling wave amplifying unit 129 is connected to the first coupling structure 123 and the input end of the second single stage traveling wave amplifying unit 129 is connected to the second coupling structure 125.

In the antenna with the foregoing structure, a first single stage traveling wave amplifying unit 126 and a second single stage traveling wave amplifying unit 129 of each gain compensation unit are provided in parallel and are connected by using two switches 130, and therefore time-division control can be implemented between the first single stage traveling wave amplifying unit 126 and the second single stage traveling wave amplifying unit 129. In addition, because the first single stage traveling wave amplifying unit 126 and the second single stage traveling wave amplifying unit 129 are in opposite amplifying directions, corresponding signal flows are opposite, and therefore the antenna is capable of time-division bidirectional communication.

In an embodiment, the feed structure provided on the bottom board 2 may be of various structures, for example: a coaxial line feed structure; or a waveguide feed structure, such as a rectangular waveguide feed structure, as long as a rectangular waveguide, in size, is a standard waveguide of a corresponding operating frequency band; likewise, to enable the rectangular waveguide to excite a corresponding TE wave and TM wave to the maximum extent, a placement method of the rectangular waveguide requires that a longitudinal side of the rectangular waveguide is in a direction the same as a propagation direction of the TE wave and a latitudinal side of the rectangular waveguide is in a direction the same as a propagation direction of the TM wave, that an waveguide aperture plane of the rectangular waveguide is parallel to the bottom board 2 and located under the bottom board 2, and that a rectangular opening, with the same size as the waveguide aperture of the rectangular waveguide, is provided on the bottom board to guide a signal from the rectangular waveguide to the antenna, so as to feed electricity to the antenna; or an electric dipole feed structure, where a length of an electric dipole is generally one half of a wavelength, where to enable the electric dipole to excite a corresponding TE wave and TM wave to the maximum extent, a placement method of the electric dipole is that a direction of the electric dipole is parallel to the bottom board 2 and parallel to a propagation direction of the TM wave, and that a direction of a bi-feeder of the electric dipole is perpendicular to the bottom board 2 and located under the bottom board 2, where an opening provided on the bottom board 2 enables the electric dipole to be placed inside the antenna, so as to feed electricity to the antenna; or a folded electric dipole feed structure; or a magnetic dipole feed structure, where the feed structure is a slot groove feed structure provided on the bottom board 2, a length of a slot is approximately one half of an operating wavelength, and to enable a waveguide to generate a corresponding strongest TE wave and TM wave by means of excitation, a placement method of the feeder structure requires that a longitudinal side of the slot is in a direction the same as a propagation direction of the TE wave, where the slot may be obtained by opening a slot on a lower side of the bottom board 2, and a waveguide signal is coupled by the slot into a main structure of the antenna.

In another aspect, an embodiment of the present application further provides a wireless device, including the antenna provided in the foregoing embodiments and their implementation manners.

Obviously, persons skilled in the art can make various modifications and variations to the embodiments of the present application without departing from the spirit and scope of the present application. The present application is intended to cover these modifications and variations provided that they fall within the scope of protection defined by the following claims and their equivalent technologies.

What is claimed is:

1. An antenna, comprising:

a main body, wherein the main body comprises a top board and a bottom board that are disposed in parallel, wherein a plurality of radiation structures for signal leakage are provided on the top board, and a feed structure for signal excitation is provided on the bottom board, to generate, between the top board and the bottom board, a transverse electric (TE) wave and a transverse magnetic (TM) wave that are transmittable; and a plurality of lines of gain compensation structures for partitioning the main body to a plurality of radiation areas, wherein each radiation area comprises a portion of the plurality of radiation structures and each line of gain compensation structure comprises a plurality of gain compensation units and a shielding structure extending in an arrangement direction of the plurality of gain compensation units, wherein the shielding structure is located between the top board and the bottom board to isolate the plurality of radiation areas;

wherein each gain compensation unit comprises:

a first coupling structure, wherein the first coupling structure is located on a side of the shielding structure that faces the feed structure, and a portion of the first coupling structure is located between the top board and the bottom board;

a second coupling structure, wherein the second coupling structure is located on a side of the shielding structure that faces away from the feed structure, and a portion of the second coupling structure is located between the top board and the bottom board; and a first single stage traveling wave amplifying unit, wherein, when the first single stage traveling wave amplifying unit is working, an input end of the first single stage traveling wave amplifying unit is connected to the first coupling structure and an output end of the first single stage traveling wave amplifying unit is connected to the second coupling structure.

2. The antenna according to claim 1, wherein the top board is a metal board with a left-handed material or right-handed material structure.

3. The antenna according to claim 1, wherein the bottom board is a good-conductor metal board, or is a metal board with a left-handed material or right-handed material structure.

4. The antenna according to claim 1, wherein air is filled between the top board and the bottom board, and a support structure is provided between the top board and the bottom board to provide support between the top board and the bottom board.

5. The antenna according to claim 1, wherein a medium layer is provided between the top board and the bottom board.

6. The antenna according to claim 1, wherein, in the plurality of lines of gain compensation structures, an arrangement direction of gain compensation units in a line of gain compensation structure is perpendicular to a propagation direction of the TE wave generated by the feed structure by means of excitation, and an arrangement direction of gain compensation units in a line of gain compensation structure is perpendicular to a propagation direction of the TM wave generated by the feed structure by means of excitation.

7. The antenna according to claim 6, wherein the plurality of lines of gain compensation structures form a closed-loop gain compensation structure;

wherein the closed-loop gain compensation structure comprises two lines of gain compensation structures with an arrangement direction of gain compensation units perpendicular to the propagation direction of the TE wave and two lines of gain compensation structures with an arrangement direction of gain compensation units perpendicular to the propagation direction of the TM wave; and wherein a projection of the feed structure on a side of the bottom board that faces away from the top board is within an area bounded by a projection of the closed-loop gain compensation structure on the side of the bottom board that faces away from the top board.

8. The antenna according to claim 6, wherein in each gain compensation unit, a passive reciprocal structure is provided between the first coupling structure and the second coupling structure.

9. The antenna according to claim 8, wherein in each gain compensation unit, the first coupling structure is a first coupling probe, wherein a first end of the first coupling probe is connected to an input end of a corresponding first single stage traveling wave amplifying unit by using a conductor, and a second end of the first coupling probe extends between the top board and the bottom board;

wherein the second coupling structure is a second coupling probe, wherein a first end of the second coupling probe is connected to an output end of the corresponding first single stage traveling wave amplifying unit by using a conductor, and a second end of the second coupling probe extends between the top board and the bottom board;

when an arrangement direction of gain compensation units in a line of gain compensation structure is perpendicular to the propagation direction of the TE wave, second ends of all coupling probes form a symmetrical dipole, and a conductor between first ends of all coupling probes and the first single stage traveling wave amplifying unit is in a 180° balun structure; and when an arrangement direction of gain compensation units in a line of gain compensation structure is perpendicular to the propagation direction of the TM wave, second ends of all coupling probes form a loop structure.

10. The antenna according to claim 9, wherein:

when an arrangement direction of gain compensation units in a line of gain compensation structure is perpendicular to the propagation direction of the TE wave, a distance from each coupling probe to the shielding structure is one fourth of a wavelength of the TE wave; and when an arrangement direction of gain compensation units in a line of gain compensation structure is perpendicular to the propagation direction of the TM wave, a distance from each coupling probe to the shielding structure is one half of a wavelength of the TM wave.

11. The antenna according to claim 10, wherein:

when an arrangement direction of gain compensation units in a line of gain compensation structure is perpendicular to the propagation direction of the TE wave, a distance between two adjacent coupling probes is less than or equal to one half of the wavelength of the TE wave; and when an arrangement direction of gain compensation units in a line of gain compensation structure is perpendicular to the propagation direction of the TM wave, a distance between two adjacent coupling probes is less than or equal to one half of the wavelength of the TM wave.

12. The antenna according to claim 1, wherein an arrangement direction of gain compensation units in each line of gain compensation structure is perpendicular to a propagation direction of the TE wave generated by the feed structure by means of excitation.

13. The antenna according to claim 1, wherein an arrangement direction of gain compensation units in each line of gain compensation structure is perpendicular to a propagation direction of the TM wave generated by the feed structure by means of excitation.

14. The antenna according to claim 1, wherein the plurality of radiation structures for signal leakage and provided on the top board comprise:

a plurality of rectangular opening grooves provided on the top board, wherein rectangular opening grooves in each radiation area are arranged in an array, and of any two adjacent side walls of each rectangular opening groove, one side wall is perpendicular to a propagation direction of the TM wave generated by the feed structure by means of excitation and an other side wall is perpendicular to a propagation direction of the TE wave generated by the feed structure by means of excitation.

15. The antenna according to claim 1, wherein parallel long grooves are provided on the top board, wherein a longitudinal direction of the parallel long grooves is perpendicular to a propagation direction of the TM wave generated by the feed structure by means of excitation, or a longitudinal direction of the parallel long grooves is perpendicular to a propagation direction of the TE wave generated by the feed structure by means of excitation.

16. The antenna according to claim 1, wherein in each gain compensation unit, the first single stage traveling wave amplifying unit is located on a side of the top board that faces away from the bottom board, a medium layer is provided between the top board and each single stage traveling wave amplifying unit, and a ground end of each single stage traveling wave amplifying unit is connected to the top board by using a ground wire.

17. The antenna according to claim 1, wherein each gain compensation unit further comprises a second single stage traveling wave amplifying unit, a first switch structure is provided between an input end of the second single stage traveling wave amplifying unit and the second coupling structure, and between an output end of the first single stage traveling wave amplifying unit and the second coupling structure, and a second switch structure is provided between an output end of the second single stage traveling wave amplifying unit and the first coupling structure, and between the input end of the first single stage traveling wave amplifying unit and the first coupling structure, wherein when both the first switch structure and the second switch structure are in a first state, the input end of the first single stage traveling wave amplifying unit is connected to the first coupling structure and the output end of the first single stage traveling wave amplifying unit is connected to the second coupling structure; and when both the first switch structure and the second switch structure are in a second state, the output end of the second single stage traveling wave amplifying unit is connected to the first coupling structure and the input end of the second single stage traveling wave amplifying unit is connected to the second coupling structure.

18. A wireless device, comprising:

an antenna; and a processor;

wherein the processor is coupled to the antenna, and wherein the antenna comprises:

a main body, wherein the main body comprises a top board and a bottom board that are disposed in parallel, wherein a plurality of radiation structures used for signal leakage are provided on the top board, and a feed structure used for signal excitation is provided on the bottom board, to generate, between the top board and the bottom board, a transverse electrical (TE) wave and a transverse magnetic (TM) wave that are transmittable; and a plurality of lines of gain compensation structures, for partitioning the main body to a plurality of radiation areas, wherein each radiation area comprises a portion of the plurality of radiation structures and each line of gain compensation structure comprises a plurality of gain compensation units and a shielding structure extending in an arrangement direction of the plurality of gain compensation units, wherein the shielding structure is located between the top board and the bottom board to isolate the plurality of radiation areas, and each gain compensation unit comprises:

a first coupling structure, wherein the first coupling structure is located on a side of the shielding structure that faces the feed structure, and a portion of the first coupling structure is located between the top board and the bottom board;

a second coupling structure, wherein the second coupling structure is located on a side of the shielding structure that faces away from the feed structure, and a portion of the second coupling structure is located between the top board and the bottom board; and a first single stage traveling wave amplifying unit, wherein when the first single stage traveling wave amplifying unit is working, an input end of the first single stage traveling wave amplifying unit is connected to the first coupling structure and an output end of the first single stage traveling wave amplifying unit is connected to the second coupling structure.

* * * * *